US010088148B2

(12) United States Patent
Herr et al.

(10) Patent No.: US 10,088,148 B2
(45) Date of Patent: Oct. 2, 2018

(54) HANDHELD TOOL CARRYING CASE

(75) Inventors: Tobias Herr, Stuttgart (DE); Georgios Margaritis, Schwieberdingen (DE); Joerg Welke, Ettlingen-Schoellbronn (DE)

(73) Assignee: ROBERT BOSCH GMBH, Stuttgart (DE)

( * ) Notice: Subject to any disclaimer, the term of this patent is extended or adjusted under 35 U.S.C. 154(b) by 66 days.

(21) Appl. No.: 13/370,069

(22) Filed: Feb. 9, 2012

(65) Prior Publication Data

US 2012/0257379 A1 Oct. 11, 2012

(30) Foreign Application Priority Data

Apr. 6, 2011 (DE) ..... 10 2011 006 871

(51) Int. Cl.
*F21V 33/00* (2006.01)
*F21V 29/76* (2015.01)
*B25H 3/02* (2006.01)

(52) U.S. Cl.
CPC ..... *F21V 33/0084* (2013.01); *B25H 3/02* (2013.01); *F21V 29/763* (2015.01)

(58) Field of Classification Search
CPC .. F21V 29/004; F21V 33/0084; F21V 29/763; F21K 9/00; B25H 3/02
USPC ..... 362/294, 373, 154
See application file for complete search history.

(56) References Cited

U.S. PATENT DOCUMENTS

| | | | | |
|---|---|---|---|---|
| 4,697,379 | A * | 10/1987 | McPhaul | 43/54.1 |
| 5,624,029 | A | 4/1997 | Shih | |
| 5,685,421 | A * | 11/1997 | Gilmore | 206/216 |
| 6,254,251 | B1 * | 7/2001 | Washington | 362/154 |
| 6,267,240 | B1 * | 7/2001 | Callaway | 206/373 |
| 6,283,292 | B1 * | 9/2001 | Chen | 206/373 |
| 7,252,404 | B1 * | 8/2007 | Messamore | 362/154 |
| 7,766,511 | B2 * | 8/2010 | Zampini et al. | 362/294 |
| 8,157,337 | B2 * | 4/2012 | Manalang et al. | 312/249.8 |
| 2004/0125597 | A1 * | 7/2004 | Einav | 362/154 |
| 2004/0228114 | A1 * | 11/2004 | Chen | 362/84 |
| 2006/0098441 | A1 * | 5/2006 | Chou | F21K 9/00 362/294 |
| 2007/0103892 | A1 * | 5/2007 | McDaniel et al. | 362/119 |
| 2008/0205048 | A1 * | 8/2008 | Andrews | 362/156 |
| 2011/0199768 | A1 * | 8/2011 | Kuo et al. | 362/249.02 |

FOREIGN PATENT DOCUMENTS

| | | |
|---|---|---|
| CN | 2902610 | 5/2007 |
| CN | 201184573 | 1/2009 |
| CN | 201412808 | 2/2010 |
| DE | 200 01 254 | 5/2000 |
| DE | 20 2009 002 276 | 5/2009 |
| WO | WO 2011/147626 | 12/2011 |

* cited by examiner

*Primary Examiner* — Bryon T Gyllstrom
(74) *Attorney, Agent, or Firm* — Norton Rose Fulbright US LLP; Gerard Messina

(57) ABSTRACT

A handheld tool carrying case has an illuminating device, which has at least one illumination arrangement. It is provided that the illuminating device has at least one cooling element for cooling the illumination arrangement.

21 Claims, 2 Drawing Sheets

HANDHELD TOOL CARRYING CASE

RELATED APPLICATION INFORMATION

The present application claims priority to and the benefit of German patent application no. 10 2011 006 871.6, which was filed in Germany on Apr. 6, 2011, the disclosure of which is incorporated herein by reference.

The present application is also related to German patent application no. 10 2011 002 408.5, which was filed in Germany on Jan. 3, 2011, the disclosure of which is also incorporated herein by reference.

FIELD OF THE INVENTION

The present invention relates to a handheld tool carrying case.

BACKGROUND INFORMATION

A handheld tool carrying case, having an illuminating device which has at least one illuminating device, is understood to have been proposed before.

SUMMARY OF THE INVENTION

The exemplary embodiments and/or exemplary methods of the present invention relate to a handheld tool carrying case having an illuminating device which has at least one illumination arrangement.

The illuminating device has at least one cooling element for cooling the illumination arrangement. By an "illuminating device" one should understand in particular a device that is provided for illuminating a working area. In particular, a "illumination arrangement" should be understood as being provided to emit light in a visible frequency range. The illumination arrangement may have at least one optical system. A "cooling element" should be understood particularly to be provided to carry off heat from the illumination arrangement, and to release it to the surrounding air. The cooling element may have at least two cooling ribs. During operation, the cooling ribs may be provided to cool the temperature of a surface of the cooling element to less than 80 degrees, advantageously less than 60 degrees, especially advantageously less than 40 degrees above the surrounding air. The cooling element may be produced at least of a material having a thermal conductivity greater than 100 W/mK, and may especially be greater than 200 W/mK.

For heat transport, the cooling element has at least copper, at least one heat pipe and/or particularly advantageously at least aluminum. By the expression "for cooling the illumination arrangement" one should understand that the cooling element and the illumination arrangement are connected especially in a heat-conductive manner. The cooling element and the illumination arrangement are connected in a heat-conductive manner that appears meaningful to one skilled in the art, but are advantageously adhered to each other using a heat-conductive adhesive and/or are particularly pressed together in a planar manner. Because of the configuration of the handheld tool carrying case according to the exemplary embodiments and/or exemplary methods of the present invention, in a constructively simple manner, a particularly efficient illumination arrangement may be operated, and in this context, a long service life of the illumination arrangement is able to be achieved.

Furthermore, it is provided that the illumination arrangement has at least one light-emitting diode, whereby low energy consumption and a particularly long service life may be achieved. By "light-emitting diode" one should especially understand a light-emitting diode operated in the forward direction. The light-emitting diode may emit white light.

Moreover, it is provided that the illumination arrangement has at least two light-emitting diodes, whereby in a constructively simple manner, a low dazzling effect and advantageous cooling at high output are made possible. The illumination arrangement particularly has more than 4, advantageously more than 10, and especially advantageously more than 40 diodes. The light-emitting diodes altogether may have an output greater than 2 W, advantageously greater than 5 W, and especially advantageously greater than 20 W. The light-emitting diodes may emit white light.

In a further embodiment, it is provided that the cooling element essentially encloses the illumination arrangement in at least one plane, whereby the illumination arrangement are protected in a particularly advantageous manner. By the expression "at least essentially enclose in one plane" it should be understood that the cooling element surrounds the illumination arrangement in one plane over at least 180 degrees, advantageously over at least 270 degrees, especially advantageously over 360 degrees.

Furthermore, it is provided that the illuminating device have at least one sealing element, which is situated between the cooling element and the illumination arrangement for protection from dust and/or moisture, whereby a particularly reliable operation on a building site is made possible. By a "sealing element" one should particularly understand a seal that appears meaningful to one skilled in the art, but advantageously is an O-ring. The sealing element is advantageously developed in a rubber-elastic manner. By "protection from dust and/or moisture" one should particularly understand that the sealing element obstructs the penetration of dust and/or moisture. The illuminating device may be protected at least according to Protective Class IP44, advantageously according to Protective Class IP56, particularly advantageously according to Protective Class IP67. By "situated between the cooling element and the illumination arrangement one should particularly understand that the sealing element lies especially completely on straight lines that intersect the cooling element and the illumination arrangement.

In addition, it is provided that the handheld tool carrying case includes a housing element that is screwed together with the cooling element, whereby in a constructively simple manner an advantageously great stability is able to be achieved. In particular, the cooling element stiffens the housing element. By "housing element" one should especially understand an element which at least partially borders on a storage space, that is provided to accommodate a handheld tool and/or to accommodate an arrangement required to be worked on, using a handheld tool. At least the cooling element is advantageously connected permanently to a base carrier case, or especially advantageously connected permanently to a carrying case cover.

Alternatively or in addition, at least the cooling element, but advantageously also the illuminating device, could be detachably connected by an operator, especially using no tool. The illuminating device could advantageously be provided to illuminate a working space, that is mechanically separated from the handheld tool carrying case, namely, in particular connected to the handheld tool carrying case together with a connecting arrangement for a battery pack or using a cable. By a "base carrying case" one should particularly understand a part of the handheld tool carrying case that is provided for positioning a handheld tool in an accommodating region when the carrying case cover is open. The base carrying case may have at least one arrangement for fastening the handheld tool. The fastening arrangement may fasten the handheld tool in a direction parallel to a main extension of the base carrying case, particularly with form locking and/or also when the carrying case cover is open. The handheld tool is advantageously developed as a handheld tool appearing meaningful to one skilled in the art, particularly such as a drilling machine, a hammer drill, a saw, a plane, a screwdriver, a milling tool, a grinder, an angle sander, a gardening tool and/or a multifunctional tool. By "carrying case cover" one should particularly understand a part of the handheld tool carrying case which, in a closed state, covers the accommodation space of the base carrying case, at least for the most part. In a direction perpendicular to its main extension, the carrying case cover may have a smaller spatial extension than the base carrying case has in a direction perpendicular to its main extension.

Furthermore, it is provided that the handheld tool carrying case have a connecting arrangement that is provided to connect to what may be an integrated battery pack, particularly an handheld tool battery pack for the energy supply of the illumination arrangement, whereby an advantageous mains-independent operation is made possible. In particular, for the operation of the illumination arrangement and of handheld tools, only one battery pack type has to be supplied. By a "connecting arrangement" one should understand to mean provided for producing a mechanical and electrical connection to the battery pack, which is advantageously able to be disconnected by an operator, especially while not using any tool. "Integrated" should particularly be understood to mean that the height, width and depth of the handheld tool carrying case remain unchanged by inserting and/or removing the battery pack.

"Battery pack" should be understood to mean a unit provided to emit chemically stored energy as electric power. By "handheld machine tool battery pack" one should particularly understand a battery pack provided to supply an handheld machine tool with electrical energy. The handheld tool battery pack in particular has temperature monitoring and/or undervoltage protection. The handheld tool battery pack may be provided to supply at least 50 W, advantageously at least 100 W, particularly advantageously at least 200 W of power. By the expression "for the energy supply of the illumination arrangement" one should especially understand that during operation, electric power flows from the connecting arrangement to the illumination arrangement.

In one advantageous development of the present invention, it is provided that the cooling element have at least one projection area greater than 100 $cm^2$, whereby a great cooling effect and an attractive design may be achieved. By "projection area" one should particularly understand an extension on a single plane.

Furthermore, it is provided that the illumination arrangement has an illumination area greater than 50 $cm^2$, advantageously greater than 100 $cm^2$, especially advantageously greater than 200 $cm^2$, whereby in a constructively simple manner a low dazzling effect may be achieved. By "illumination area" one should particularly understand an area by which a luminous flux is radiated from the illumination arrangement. The illuminations area may be a surface of a disk that protects the light-emitting diodes. Alternatively or in addition, the illumination area could be formed of a smallest continuous area set up by the light-emitting diodes, and particularly so if the light-emitting diodes are not covered by a continuous pane. The projection area and the illumination area are advantageously aligned in parallel.

Furthermore, it is provided that the illumination arrangement has an illumination area which is at least partially recessed, whereby the illumination area is advantageously protected from mechanical effects. In particular, by the expression "recessed" one should understand that an element of the handheld tool carrying case, advantageously at least the cooling element, extends outwards in the direction of illumination beyond a plane spanned by the illumination area. The element may border on the illumination area. By "at least partially recessed" one should understand, especially in this connection, that at least one region of the illumination area lies on a straight line which is aligned parallel to a plane spanned by the illumination area, and which intersects the element that extends beyond the plane on two different sides of the illumination area. The region may have at least one center of the illumination area.

At least one additional straight line, that is aligned in parallel to the plane spanned by the illumination plane, and which is aligned perpendicular to the first straight line, advantageously intersects the element. The element may enclose the illumination area in a plane spanned by the illumination area by more than 180 degrees, advantageously by more than 270 degrees, especially advantageously by 360 degrees.

It is further provided that the handheld tool carrying case have a carrying case wall on whose plane of main extension at least the illuminating device is situated, whereby a particularly space-saving arrangement of the illuminating device is made possible. By a "carrying case wall" one should understand especially an outer wall of the handheld tool carrying case, particularly a sidewall, a bottom wall and/or advantageously a cover wall. By a "plane of main extension" one should particularly understand a plane which runs in parallel to an average outer side of the carrying case wall, and which is situated at the height of a volume center of the carrying case wall. On at least one main plane of extension of the illuminating device there may be situated, in each case at least partially, the cooling element, a carrying handle, the electronics, one of the carrying case walls and/or the connecting arrangement for connecting to the battery pack. The plane of main extension of the illuminating device is advantageously a plane that intersects the illuminating device and which is aligned parallel to the illumination plane.

In a further embodiment, it is provided that the illuminating device, in an area of an illumination area of the illuminating device perpendicular to the illumination area, have a maximum extension of less than 40 mm, which may be less than 30 mm, especially may be less than 20 mm, whereby advantageously there is much available space in the handheld tool carrying case. By the expression "in an area of an illumination area" one should particularly understand that a straight line running along the extension intersects the illuminating device. An area of at least 30% of the illumination area, advantageously at least 60% of the illumination area, particularly advantageously an area of the entire illumination area, which may have has this maximum extension. The carrying case cover and the illuminating device together may have this maximum extension.

Further advantages are derived from the description of the figures that follow. The drawings show an exemplary embodiment of the present invention. The drawings, the description, and the claims include numerous features in combination. One skilled in the art will expediently consider the features also individually, and will combine them into useful further combinations.

DETAILED DESCRIPTION

Figure 1:
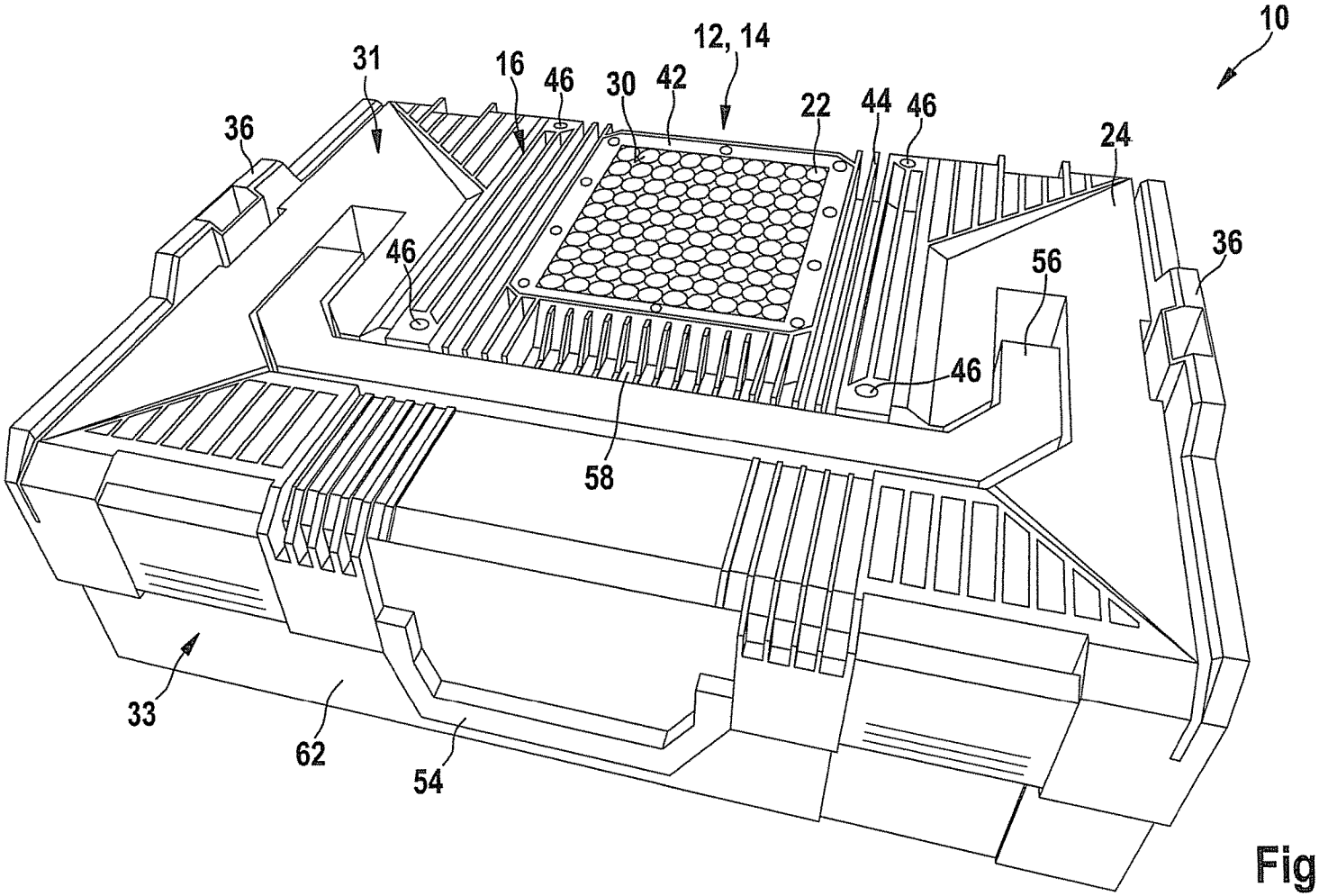
FIG. 1 shows a handheld tool carrying case having an illuminating device and a cooling element in a perspective representation.
Figure 2:
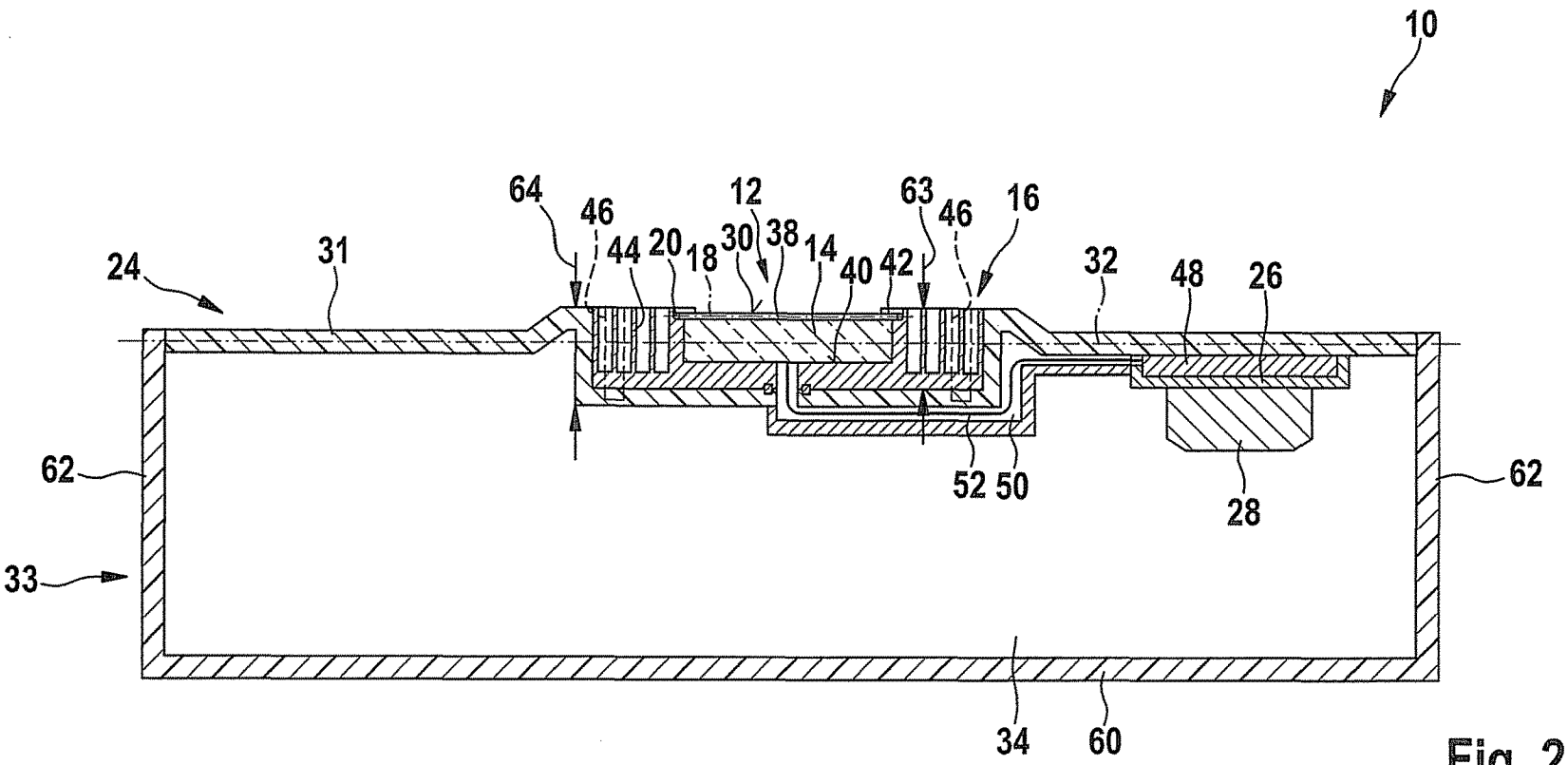
FIG. 2 shows a schematic section of the handheld tool carrying case of FIG. 1.

FIG. 1 and FIG. 2 show an handheld tool carrying case 10 having an illuminating device 12, a cooling element 16, a first and a second housing element 24, 33 and a connecting arrangement 26. First housing element 24 is developed as a carrying case cover. Second housing element 33 is developed as a base carrying case. The two housing elements 24, 33 together border on a storage space 34. Second housing element 33 has am upper stacking arrangement 36 and a lower stacking arrangement that are not shown in greater detail. Upper stacking arrangement 36 is provided to latch with a lower stacking arrangement of an additional handheld tool carrying case, that is not shown in greater detail. A plurality of handheld tool carrying cases are thus able to be connected to form one easily transportable stack.

Illuminating device 12 has illumination arrangement 14. Illumination arrangement 14 has sixty light-emitting diodes 22 and just as many optical systems. The optical systems are developed as reflectors. For this purpose, the optical systems are vapor-deposited with chromium. Light-emitting diodes 22 are arranged in ten rows and six columns. Illumination arrangement 14 has a pane 38, which covers light-emitting diodes 22 protectively. One surface of pane 38 forms an illumination area 30 of illumination arrangement 14. Illumination area 30 is larger than 200 $cm^2$. During operation, cooling element 16 cools light-emitting diodes 22 of illumination arrangement 14. To do this, cooling element 16 has a planar surface 40, onto which illumination arrangement 14 are pressed. Illuminating device 12 has an holder 42, which fastens illumination arrangement 14. Holder 42 is screwed together with cooling element 16.

Illumination area 30 is recessed by more than 0.5 mm, and, in this exemplary embodiment, by about 1 mm. Cooling element 16 and holder 42, as seen in the illuminating direction, are situated partially behind illumination area 30. This means that cooling element 16 and holder 42 extend beyond illumination area 30, in the illuminating direction. Cooling element 16 and holder 42 enclose illumination area 30. Consequently, cooling element 16 and holder 42 protect illumination area 30.

Cooling element 16 encloses illumination arrangement 14 in a plane 18 over 360 degrees. Between cooling element 16 and illumination arrangement 14 there is a sealing element 20. Sealing element 20 encloses illumination arrangement 14, also in a plane 18 over 360 degrees. Sealing element 20 protects light-emitting diodes 22 from dust and moisture. Cooling element 16 has a plurality of cooling ribs 44. Cooling element 16 is made of aluminum. Illumination arrangement 14 are situated completely in one recess of cooling element 16, which means that illumination arrangement 14 do not extend out of the recess. Cooling element 16 is firmly connected to first housing element 24, namely, cooling element 16 is screwed together with housing element 24 using screws 46. Screws 46 are screwed in from a side of first housing element 24 facing away from storage space 34. Alternatively, screws could be screwed in from the side of first housing element 24 facing storage space 34. Cooling element 16 has a projection area that is larger than 300 $cm^2$. The projection area is aligned parallel to a main plane of extension of pane 38.

Connecting arrangement 26 of handheld tool carrying case 10 is connected to a battery pack 28, in an operation-ready state. Battery pack 28 is developed as an handheld tool battery pack. In a connected state, battery pack 28 is situated in storage space 34. During operation of illuminating device 12, battery pack 28 supplies light-emitting diodes 22 with electrical energy. For this, illuminating device 12 has an electronic system 48. Electronic system 48 makes a constant current available during operation for operating light-emitting diodes 22. Electronic system 48 is situated between connecting arrangement 26 and first housing element 24. An electronic system could alternatively be situated in the recess of cooling element 16. First housing element 24 has a channel 50. A cable 52 runs through channel 50. Cable 52 connects electronic system 48 to illumination arrangement 14. Channel 50 runs on the side of first housing element 24 facing storage space 34. Cooling element 16 has a bore through which cable 52 is guided into the recess of cooling element 16.

First housing element 24 has a first carrying handle 54 and a second carrying handle 56. First carrying handle 54 is situated on the narrow side of handheld tool carrying case 10. Second carrying handle 56 is situated on the wide side of handheld tool carrying case 10. In a folded closed state, second carrying handle 56 is situated in a recess of first housing element 24. Cooling element 16 has a free region 58, using which an operator is able to grasp under second carrying handle 56 when the case is folded closed.

Handheld tool carrying case 10 has six carrying case walls, namely, one cover wall 31, one bottom wall 60 and four sidewalls 62. Cover wall 31 includes a plane of main extension 32, on which illuminating device 12 is situated, that is, parts it. On the at least one plane of main extension 32 of illuminating device 12, electronic system 48, second carrying handle 56 and cover wall 31 are partially situated. Connecting arrangement 26 for connecting to battery pack 28 are situated on an additional plane of main extension of illuminating device 12, that is not marked.

In an area of illumination area 30 of illuminating device 12, in a direction perpendicular to illumination area 30, illuminating device 12 has a maximum extension 63, which is less than 40 mm. Maximum extension 63 amounts to 15 mm. A maximum extension 64 of first housing element 24, that is, of the carrying case cover, having illuminating device 12 and connecting arrangement 26 amounts to less than 50 mm, specifically 25 mm, in this case, perpendicular to illumination area 30.

What is claimed is:

1. A handheld tool carrying case, comprising:

an illuminating device, which has at least one illumination arrangement that provides illumination along an illumination direction;

wherein the illuminating device has at least one cooling element for cooling the illumination arrangement, wherein:

the at least one cooling element includes an opening into which the illuminating arrangement is inserted, the at least one cooling element includes a plurality of cooling ribs displaced from the illuminating arrangement and exposed in an uncovered state to an external environment, and the uncovered cooling ribs extend toward the external environment in the illumination direction;

a first housing element embodied as a carrying case cover;

a second housing element embodied as a carrying case base, wherein the first housing element and the second housing element are configured to enclose a storage space of the handheld tool carrying case; and a connecting arrangement for connecting a battery pack of the handheld tool carrying case as an energy supply of the illumination arrangement, wherein:

an external surface of the first housing element includes an opening into which the cooling element is inserted, and an internal surface of the first housing element includes a connecting arrangement configured to releasably connect the battery pack of the handheld tool carrying case which, in a connected state, is arranged in the storage space of the handheld tool carrying case.

2. The handheld tool carrying case of claim 1, wherein the illumination arrangement has at least one light-emitting diode.

3. The handheld tool carrying case of claim 1, wherein the illumination arrangement has at least two light-emitting diodes.

4. The handheld tool carrying case of claim 1, wherein the cooling element at least substantially encloses the illumination arrangement in at least one plane.

5. The handheld tool carrying case of claim 1, wherein the illuminating device has at least one sealing element, which is situated for protection from at least one of dust and moisture between the cooling element and the illumination arrangement.

6. The handheld tool carrying case of claim 1, further comprising:

a housing element, which is screwed together with the cooling element;

wherein the cooling element is distinct from and attached to the housing element.

7. The handheld tool carrying case of claim 1, wherein the cooling element has at least one projection area larger than 100 $cm^2$.

8. The handheld tool carrying case of claim 1, wherein the illumination arrangement has an illumination area larger than 50 $cm^2$.

9. The handheld tool carrying case of claim 8, wherein the illumination arrangement has an illumination area which is at least partially recessed.

10. The handheld tool carrying case of claim 1, further comprising:

a carrying case wall, on whose plane of main extension at least the illuminating device is situated.

11. The handheld tool carrying case of claim 10, wherein the carrying case wall is a cover wall of the handheld tool carrying case.

12. The handheld tool carrying case of claim 11, wherein the cover wall includes a carrying handle adapted for carrying the handheld tool carrying case.

13. The handheld tool carrying case of claim 1, wherein in an area of an illumination area of the illuminating device perpendicular to the illumination area, the illuminating device has a maximum extension that is smaller than 40 mm.

14. The handheld tool carrying case of claim 1, wherein the illumination arrangement is configured to illuminate a working area.

15. The handheld tool carrying case of claim 1, wherein the illumination arrangement includes a plurality of light-emitting diodes which together have an output greater than 2 W.

16. The handheld tool carrying case of claim 15, wherein the plurality of light-emitting diodes are arranged in a plurality of rows and columns adapted to provide an illumination area of greater than 200 $cm^3$.

17. The handheld tool carrying case of claim 1, wherein the illuminating device includes a holder configured to attach to the illumination arrangement, the holder being attached to the cooling element, wherein the holder and the cooling element enclose and extend beyond an illumination area of the illumination arrangement in an illuminating direction and are adapted to protect the illumination area.

18. The handheld tool carrying case of claim 1, further comprising a channel disposed on an interior surface of the carrying case and sized to accommodate a cable for connection to the illuminating arrangement.

19. The handheld tool carrying case of claim 1, further comprising:

a first housing element embodied as a carrying case cover and a second housing element embodied as a carrying case base, wherein the first housing element and the second housing element are configured to enclose a storage space of the handheld tool carrying case, and wherein the cooling element is attached to an external surface of the first housing element.

20. The handheld tool carrying case of claim 1, further comprising:

a first housing element embodied as a carrying case cover and a second housing element embodied as a carrying case base, wherein the first housing element and the second housing element are configured to enclose a storage space of the handheld tool carrying case, and wherein the opening of the cooling element has a base surface to which the illuminating arrangement is attached.

21. The handheld tool carrying case of claim 1, further comprising:

a first housing element embodied as a carrying case cover and a second housing element embodied as a carrying case base, wherein the first housing element and the second housing element are configured to enclose a storage space of the handheld tool carrying case, and wherein the opening of the cooling element is covered by a pane that is attached to the cooling element via a frame-like holder surrounding the opening of the cooling element.

* * * * *